US009351383B2

(12) United States Patent
Janning

(10) Patent No.: US 9,351,383 B2
(45) Date of Patent: May 24, 2016

(54) DC OPERATED CHRISTMAS LIGHT STRING

(71) Applicant: JLJ, Inc., Bellbrook, OH (US)

(72) Inventor: John L. Janning, Bellbrook, OH (US)

(73) Assignee: JLJ, Inc., Bellbrook, OH (US)

( * ) Notice: Subject to any disclaimer, the term of this patent is extended or adjusted under 35 U.S.C. 154(b) by 0 days.

(21) Appl. No.: 14/753,880

(22) Filed: Jun. 29, 2015

(65) Prior Publication Data

US 2016/0050739 A1 Feb. 18, 2016

Related U.S. Application Data

(60) Provisional application No. 62/038,108, filed on Aug. 15, 2014.

(51) Int. Cl.
*H05B 39/09* (2006.01)
*H05B 37/03* (2006.01)

(52) U.S. Cl.
CPC ..... *H05B 39/09* (2013.01); *H05B 37/036* (2013.01)

(58) Field of Classification Search
USPC ..... 315/185 R, 185 S
See application file for complete search history.

(56) References Cited

U.S. PATENT DOCUMENTS 6,765,313 B2 7/2004 Janning
6,972,528 B2 * 12/2005 Shao ..... H05B 33/0809 315/185 R
8,736,182 B1 5/2014 Janning
2002/0047594 A1 * 4/2002 Janning ..... H01K 1/625 318/185 S

* cited by examiner

*Primary Examiner* — Thuy Vinh Tran
*Assistant Examiner* — Jonathan Cooper
(74) *Attorney, Agent, or Firm* — Blank Rome LLP

(57) ABSTRACT

A string set of series-connected incandescent bulbs in which the bulbs are individually provided with a voltage responsive shunt which is inoperative during normal operation of the string set when connected to a source of operating potential and which becomes operative only in response to an increase in the voltage thereacross which exceeds its rating, and in which the remaining bulbs of the circuit continue to receive rated current therethrough and rated voltage thereacross and further continue to be illuminated even though other bulbs in the string are either inoperative or are missing from their respective sockets. The string includes a split bridge AC to DC converter which provides pulsating DC current to the shunted, series-connected incandescent bulbs.

7 Claims, 3 Drawing Sheets

DC OPERATED CHRISTMAS LIGHT STRING

This application claims the benefit of U.S. Provisional Application No. 62/038,108, filed Aug. 15, 2014.

TECHNICAL FIELD

One of the most common uses of light strings is for decoration and display purposes, particularly during Christmas and other holidays, and more particularly for the decoration of Christmas trees, and the like. Probably the most popular light set currently available on the market, and in widespread use, comprises one or more strings of fifty miniature light bulbs each, with each bulb typically having an operating voltage rating of 2.5 volts, and whose filaments are connected in an electrical series circuit arrangement. If overall sets of more than fifty bulbs are desired, the common practice is to provide a plurality of fifty miniature bulb strings, with the bulbs in each string connected in electrical series, and with the plurality of strings being connected in a parallel circuit arrangement. As each bulb of each string is connected in series, when a single bulb fails to illuminate for any reason, the whole string fails to light and it is very frustrating and time consuming to locate and replace a defective bulb or bulbs. Usually many bulbs have to be checked before finding the failed bulb. In fact, in many instances, the frustration and time consuming efforts are so great as to cause one to completely discard and replace the string with a new string before they are even placed in use. The problem is even more compounded when multiple bulbs simultaneously fail to illuminate for multiple reasons, such as, for example, one or more faulty light bulbs, one or more unstable socket connections, or one or more light bulbs physically fall from their respective sockets, and the like.

BACKGROUND OF THE INVENTION

There are presently available on the market place various devices and apparatuses for electrically testing an individual light bulb after it has been physically removed from its socket. Apparatus is also available on the market for testing Christmas tree light bulbs by physically placing an alternating current line voltage sensor in close proximity to the particular light bulb desired to be tested. However, such a device is merely an electromagnetic field strength detection device which many remain in an "on" condition whenever the particular Christmas tree light bulb desired to be tested is physically located in close proximity to another light bulb or bulbs on the Christmas tree.

Light bulb manufacturers have also attempted to solve the problem of bad bulb detection by designing each light bulb in the string in a manner, whereby the filament in each light bulb is shorted whenever it burns out for any reason, thereby preventing an open circuit condition to be present in the socket of the burned-out bulb. However, in actual practice, it has been found that such short circuiting feature within the bulb does not always operate in the manner intended and the entire string will go out whenever a single bulb burns out.

U.S. Pat. No. 6,765,313, by the present inventor, discloses and claims a circuit which solves the problem of the entire series wired string of lights going out as a direct result of either a defective socket, a light bulb being improperly placed in the socket, a broken or bent wire of a light bulb, or whenever a light bulb is either intentionally removed from its socket or is merely dislodged from its socket during handling or from movement after being strung on the Christmas tree, particularly in outdoor installations subject to wind or other climatic conditions. U.S. Pat. No. 6,765,313 teaches a novel filament shunting circuit for use in connection with a series connected string of incandescent light bulbs which completely overcomes, in a very simple, novel and economical manner, the problems associated with prior arrangements which were primarily designed to maintain some sort of current flow through the entire string of bulbs whenever one or more bulbs in the string becomes inoperable, either due to an open filament, one or more faulty bulbs, one or more faulty sockets, or simply because one or more of the bulbs are not properly mounted in their respective sockets, or are entirely removed or fall from their respective sockets.

More specifically, in accordance with the circuit of U.S. Pat. No. 6,765,313, the disclosure of which is incorporated herein in its entirety, a silicon type shunting device, preferably a Zener diode, is connected across each light bulb of the series wired light string, the Zener diode having a predetermined voltage switching value which is greater than the voltage normally applied to said bulbs, and which Zener diode shunt becomes fully conductive only when the peak voltage thereacross exceeds its said predetermined voltage switching value, which occurs whenever a bulb in the string either becomes inoperable due to any one or more or all of the following reasons: an open filament, faulty or damaged bulb, faulty socket, or simply because the bulb is not properly mounted in its respective socket, or is entirely removed or falls from its respective socket, and which circuit arrangement provides for the continued flow of rated current through all of the remaining bulbs in the string, together with substantially unchanged illumination in light output from any of those remaining operative in the string even though a substantial number of total bulbs in the string are simultaneously inoperative for any combinations of the various reasons heretofore stated.

The circuit arrangement of U.S. Pat. No. 6,765,313 includes a full bridge rectifier disposed between the AC power supply and the series wired light string to provide pulsating DC power to the light string.

SUMMARY OF THE INVENTION

The present invention provides a series-connected incandescent light bulb string having all of the features set forth above, but powered by a split bridge rectifier to convert alternating current (AC) into direct current (DC), whereby the light string is powered by pulsating DC (direct current), such that there is a cost savings by eliminating the need for a third wire in sets having end connectors.

Split bridge rectification is taught by Shao in U.S. Pat. No. 6,972,528 for use in LED (light emitting diode) light strings. LED's are electrically polarized devices and split rectifier bridge arrangement works well in a series wired LED light string. However, incandescent bulbs are not polarized and there is no need to rectify voltage for their operation. Therefore, the Shao split bridge arrangement is not needed in an ordinary series wired incandescent light string. Accordingly, Shao, not surprisingly, only mentions an LED light string in his patent, and incandescent light strings are not mentioned.

In the present invention, a polarity sensitive Zener diode is shunted across the terminals of each incandescent light bulb in accordance with U.S. Pat. No. 6,765,313, as described above. With such an arrangement, the AC input voltage must be converted into a polarized voltage for the shunted light string to operate properly. Thus, the present invention comprises the non-obvious split bridge rectification of the AC input voltage to power a series wired incandescent light bulb string in which the bulbs are shunted with Zener diodes to ensure constant illumination even when more or more incandescent bulbs in the string are missing, burned out, or otherwise inoperative.

These and other features and advantage of the present invention will become apparent when the following specification is read in conjunction with the accompanying drawings.

DESCRIPTION OF THE PREFERRED EMBODIMENTS

Figure 1:
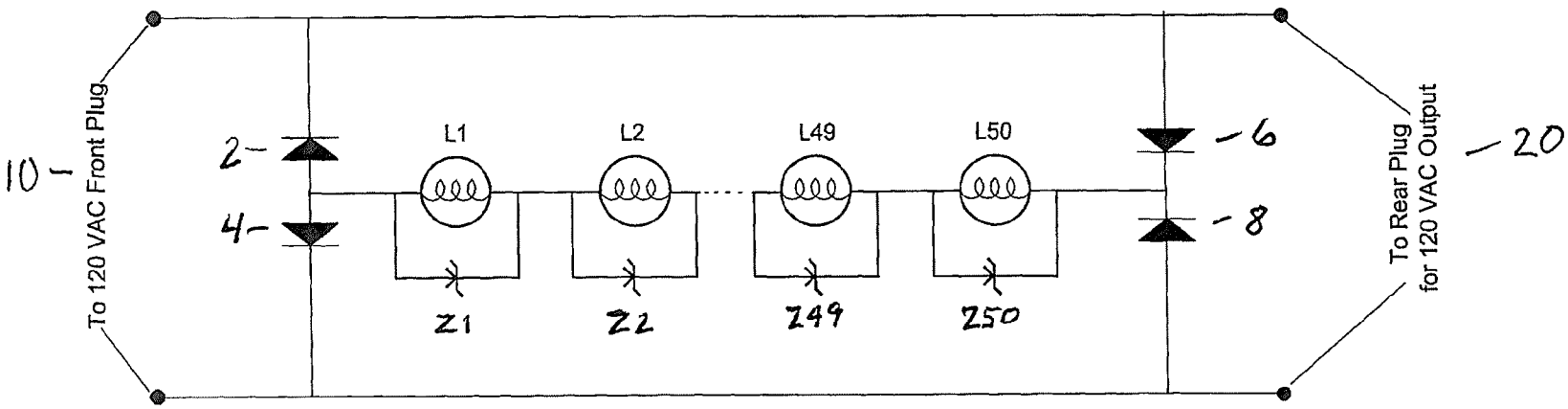
FIG. 1 is an electrical schematic diagram of a novel 50 light series connected light string constructed in accordance with an embodiment of the present invention incorporating the split bridge rectifier arrangement in the power supply.

FIG. 1 illustrates a first embodiment of the present invention, specifically a circuit arrangement which has a source of operating voltage that is a full wave rectified alternating current (AC) voltage which pulsates at twice the normal 60 cycle rate.

As shown in FIG. 1, single Zener diode devices Z1 to Z50, preferably one watt, are respectively shunted across incandescent light bulbs L1 to L50, preferably 2.5V 170 mA incandescent bulbs, which are wired in series to form a 50 miniature incandescent light bulb string.

Advantageously, in accordance with the present invention, the full bridge rectifier is split into two halves, with half of the bridge circuit, comprising rectifier diodes 2, 4 disposed at one end of the incandescent light string, and the other half of the full bridge comprising rectifier diodes 6,8 disposed at the opposite end of the light string. More specifically, at the half bridge at one end of the string, the negative ends of the rectifier diodes 2, 4 are connected together and the positive ends of rectifier diodes 2,4 are connected, respectively, to the positive and negative terminals of the AC plugs. At the half bridge at the opposite end of the string, the positive ends of rectifier diodes 6,8 are connected together and the negative ends of rectifier diodes 6,8 are connected, respectively, to the positive and negative terminal of the AC plugs. The rectifier diodes might be types similar to 1N4004.

In a preferred embodiment of the invention, each half bridge is preferably molded into the respective power cord plug/socket at the end of the light string. The front plug 10 is connected to a source voltage (typically 110 VAC). The rear plug 20 may be provided in the forms of a socket, coupled in parallel to the front plug, to enable multiple light strings to be connected to each other from end to end. The rear plug may alternatively be a dummy plug, a piece of plastic or other material acting as an end cap for the light string. In the latter case, the dummy plug can have an internally wired positive and negative connection enabling the circuit to be complete.

Figure 2:
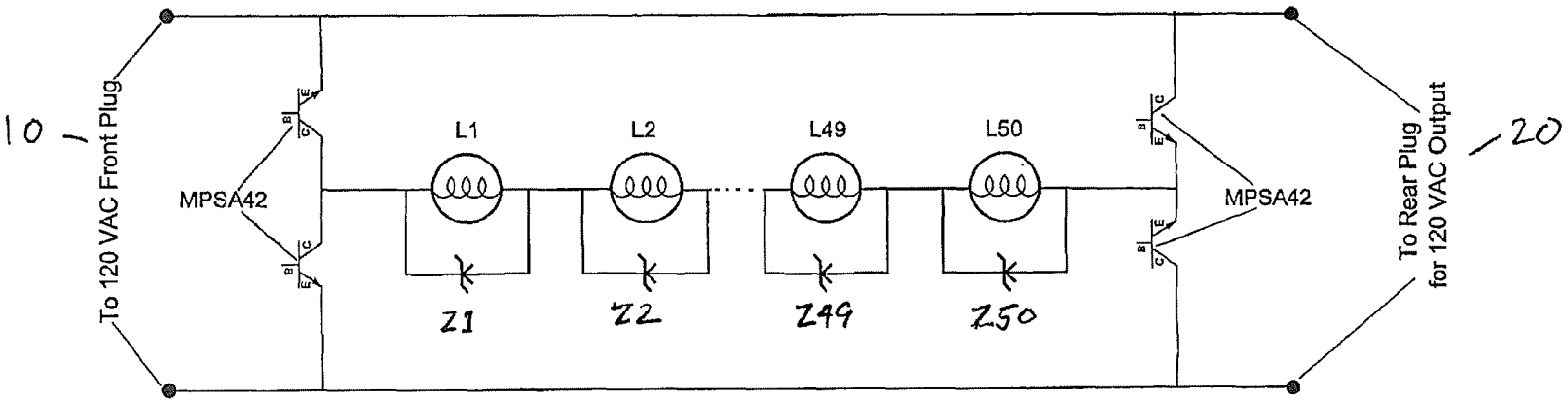
FIG. 2 is an electrical schematic diagram of a novel 50 light series connected light string constructed in accordance with the present invention as in FIG. 1, but using bipolar junction transistors as rectifiers for the split bridge rectifier.

In a further preferred embodiment, rather than using typical rectifier diodes, such a 1N4004 devices, to form the split bridge rectifier, the present invention uses bi-polar junction transistors, i.e., MPSA42 devices, as rectifiers. This is shown in FIG. 2, where the emitter and collector terminals of the MPSA42 transistors are connected in their opposite polarity direction with the base terminal of the transistors not connected. The use of MPSA42 transistors as rectifiers as shown has the advantages set forth in U.S. Pat. No. 8,736,182, the disclosure of which is herein incorporated by reference in its entirety.

Figure 3:
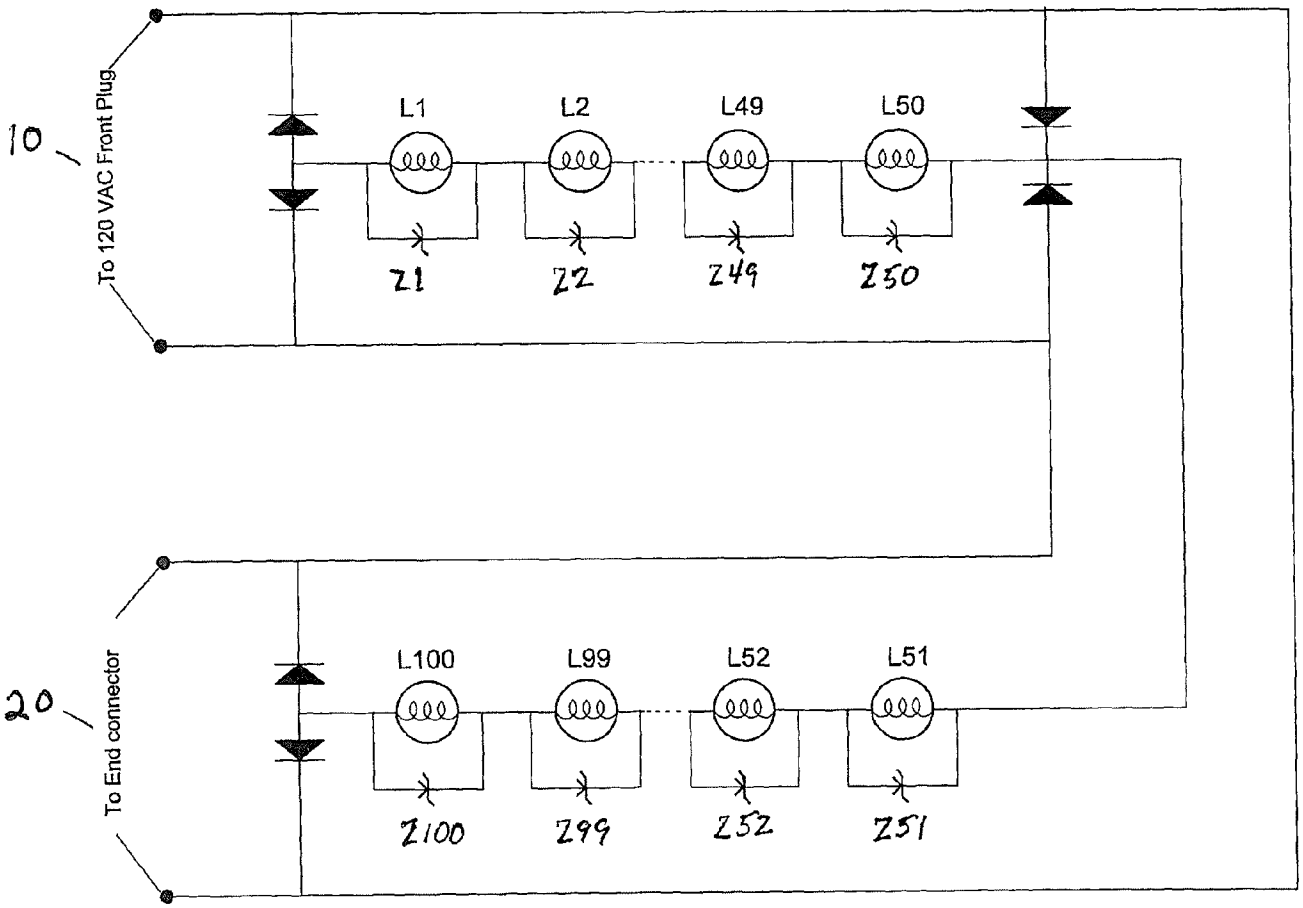
FIG. 3 is an electrical schematic diagram of a novel 100 light series connected light string constructed in accordance with an embodiment of the present invention incorporating the split bridge rectifier arrangement in the power supply.

FIG. 3 shows the wiring for a 100 light string. Note that the split bridge rectifiers (preferably MSSA42 transistors, although shown schematically as diodes) in the center of the light string are shared by both the first 50 and the last 50 incandescent lights.

Optionally, flasher bulbs can be inserted in some of the sockets for a pleasing random twinkle effect.

In operation, when a single bulb becomes inoperative for any of the various reasons previously stated, except for internal shorting, there is a voltage drop across its corresponding Zener diode shunt of approximately 0.7-0.8 peak volts in the forward direction and approximately 3.6 peak volts in the reverse, or Zener direction, when 3.6 volt Zener diodes are chosen for shunts.

It is to be understood that the above-referenced arrangements are illustrative of the principles of the present invention. It will be apparent to those of ordinary skill in the art that numerous modifications can be made without departing from the principles and concepts of the invention as set forth in the claims.

What is claimed is:

1. A series-wired incandescent light string that operates on pulsating DC current, comprising:

a first plurality of incandescent light bulbs;

a first plurality of light sockets connected in electrical series, each light socket of said plurality of series wired light sockets adapted to receive at least one incandescent light bulb of said plurality of incandescent light bulbs;

a first plurality of voltage-responsive shunts, each shunt being electrically connected in parallel across a respective light socket to maintain the current passing through the light socket in the event that an incandescent light bulb is inoperative or is missing from the light socket;

a front plug and a rear plug, each plug having at least one of a positive connection and a negative connection;

an AC to DC converter comprising at least four rectifiers in a split bridge arrangement, wherein the four rectifiers are divided into a first group and a second group; each group comprising two rectifiers, with negative ends of the two rectifiers of the first group being connected together and positive ends of the two rectifiers of the first group being connected with the positive and negative connection of the front and rear plugs, respectively, and positive ends of the two rectifying diodes of the second group being connected together and negative ends of the two rectifiers of the second group being connected with the positive and negative connection of the front and rear plugs, respectively;

wherein the first plurality of light sockets, light bulbs and shunts are connected between the negative ends of the rectifiers of the first group and the positive ends of the rectifiers of the second group, such that the AC to DC converter, in the split bridge arrangement, produces pulsating DC supply current at all times during operation of said series-wired light string, regardless of whether any of said light bulbs are inoperative or missing; and a second plurality of incandescent light bulbs, light sockets and voltage responsive shunts, and a third group of two rectifiers disposed in an arrangement similar to the first group of rectifiers, with the second plurality of incandescent light bulbs, light sockets and voltage responsive shunts connected between the negative ends of the rectifiers of the first group and the positive ends of the rectifiers of the second group.

2. The series wired light string of claim 1, wherein the rectifiers comprise bipolar junction transistors.

3. The series wired light string of claim 1, wherein the voltage responsive shunts comprise Zener diodes.

4. The series wired light string of claim 1, comprising a total of 50 series connected incandescent light bulbs.

5. The series wired light string of claim 1, comprising a total of 100 series connected incandescent light bulbs, with 50 incandescent light bulbs disposed between the first and second groups of rectifiers, and 50 incandescent light bulbs disposed between the second and third groups of rectifiers.

6. The series wired light string of claim 1, wherein the first group of rectifiers are molded into the front plug and the second group of rectifiers and molded into the rear plug.

7. The series wired light string of claim 1, wherein the first group of rectifiers are molded into the first plug and the third group of rectifiers are molded into an end connector.

* * * * *